US009186531B2

(12) United States Patent
Combs et al.

(10) Patent No.: US 9,186,531 B2
(45) Date of Patent: Nov. 17, 2015

(54) FIRE FIGHTING MONITOR

(75) Inventors: Eric Nathaniel Combs, Goshen, IN (US); Don E. Sjolin, Granger, IN (US); Todd Brian Lozier, Elkhart, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 989 days.

(21) Appl. No.: 12/760,924

(22) Filed: Apr. 15, 2010

(65) Prior Publication Data

US 2011/0253397 A1 Oct. 20, 2011

(51) Int. Cl.
*A62C 25/00* (2006.01)
*A62C 31/28* (2006.01)

(52) U.S. Cl.
CPC ..... *A62C 31/28* (2013.01)

(58) Field of Classification Search
CPC ..... A62C 25/00; A62C 31/28
USPC ..... 169/52, 46, 47, 51, 24, 25, 62, 67, 70
See application file for complete search history.

(56) References Cited

U.S. PATENT DOCUMENTS

| | | | | |
|---|---|---|---|---|
| 3,206,126 | A * | 9/1965 | Thompson | 239/281 |
| 3,575,351 | A * | 4/1971 | Warren | 239/227 |
| 3,583,637 | A | 6/1971 | Miscovich | |
| 3,604,627 | A * | 9/1971 | Miscovich et al. | 239/166 |
| 3,836,084 | A * | 9/1974 | Luke | 239/587.2 |
| 4,674,686 | A | 6/1987 | Trapp | |
| 5,301,756 | A * | 4/1994 | Relyea et al. | 169/24 |
| 6,109,360 | A | 8/2000 | Mandzukic et al. | |
| 6,145,619 | A * | 11/2000 | Risser | 182/113 |
| 6,994,282 | B2 * | 2/2006 | Trapp et al. | 239/587.2 |
| 2004/0216902 | A1 | 11/2004 | Trapp et al. | |
| 2005/0077057 | A1 * | 4/2005 | Laskaris | 169/52 |
| 2005/0167122 | A1 | 8/2005 | Trapp | |
| 2009/0008105 | A1 * | 1/2009 | Price et al. | 169/52 |

FOREIGN PATENT DOCUMENTS

WO WO2011/129975 A1 10/2011

OTHER PUBLICATIONS

International Preliminary Report on Patentability dated Oct. 16, 2012 from WIPO relating to International application No. PCT/US2011/029757.

The International Search Report and Written Opinion mailed Jun. 1, 2011 in related International Application No. PCT/US2011/029757.

* cited by examiner

*Primary Examiner* — Ryan Reis
*Assistant Examiner* — Chee-Chong Lee
(74) *Attorney, Agent, or Firm* — Faegre Baker Daniels LLP

(57) ABSTRACT

A fire-fighting monitor includes a body that has a fluid passageway and an inlet and an outlet. The inlet is adapted to mount to a base on a fire truck, and the body is configured so that the outlet is rotatable about a vertical axis over a 360 degree range of motion. In addition, the body is configured such that the outlet is rotatable about a horizontal axis over one range of motion of about 195 degrees in one form and about 270 degrees in another form.

7 Claims, 11 Drawing Sheets

FIRE FIGHTING MONITOR

TECHNICAL FIELD AND BACKGROUND OF THE INVENTION

The present invention relates to a firefighting monitor and, more specifically, to a firefighting monitor that is particularly suitable for use with fire trucks, including aircraft rescue firefighting (ARFF) trucks.

An ARFF truck is a special category of firefighting truck that is used to respond to aircraft ground emergencies. Like most fire trucks, an ARFF truck has an articulating boom with a monitor mounted to the end of the boom and also another monitor mounted at its bumper. The boom monitor is typically used to provide a water, chemical, or foam attack from a raised position above the aircraft, while the bumper monitor is typically used to provide a water, chemical, or foam attack from the under belly of the aircraft. The greater the speed of delivery of the fluids or foam, the better the outcome.

While attempts have been made to increase the size of the monitors and thereby increase the flow of the fluid or foam, with increased size typically comes increase in weight and cost to manufacture.

SUMMARY OF THE INVENTION

Accordingly, the present invention provides a monitor that can be compact in size while achieving greater flow efficiency and further a greater range of motion.

In one form of the invention, a fire-fighting monitor includes a body having a fluid passageway forming an inlet and an outlet, with the inlet being adapted to mount to a base on a fire truck, and with the body being configured so that the outlet is rotatable about a vertical axis over a 360 degree range of motion. Also, the body is configured such that the outlet is rotatable about a horizontal axis over a range of motion from about 180 degrees above horizontal to about 15 degrees below horizontal.

In another form of the invention, a fire-fighting monitor includes a body having a fluid passageway forming an inlet and an outlet, with the inlet being adapted to mount to a base on a fire truck, and with the body being configured so that the outlet is rotatable about a vertical axis over a 360 degree range of motion. The body is also configured such that the outlet is rotatable about a horizontal axis over a range of motion from about 180 degrees below horizontal to about 90 degrees above horizontal.

In yet another form of the invention, a fire-fighting monitor includes a body having a fluid passageway. The body includes an inlet pipe section forming an inlet, an intermediate pipe section, and an outlet pipe section forming an outlet, which is rotatably mounted to the intermediate pipe section about a horizontal axis. The inlet pipe section lies in a vertical plane and is adapted to mount to a base on a fire truck. The intermediate pipe section lies in a horizontal plane and is rotatably mounted to the inlet pipe section about a vertical axis. The intermediate pipe section is configured so that the intermediate pipe section and the outlet pipe section are rotatable about a vertical axis over a 360 degree range of motion. In addition, the outlet pipe section is configured to rotate relative to the intermediate pipe section about the horizontal axis between positions above and below the horizontal plane. At least one of the positions is up to 180 degrees with the outlet pipe section still clearing the intermediate pipe section such that the intermediate pipe section does not limit the rotation of the outlet pipe section.

In one aspect, the intermediate pipe section does not limit the rotation of the outlet pipe section up to about 90 degrees above horizontal. In a further aspect, the intermediate pipe section does not limit the rotation of the outlet pipe section up to about 180 degrees below horizontal.

In other aspects, the intermediate pipe section does not limit the rotation of the outlet pipe section up to about 180 degrees above horizontal. Further, the intermediate pipe section does not limit the rotation of the outlet pipe section up to about 15 degrees below horizontal.

In any of the above monitors, the monitor may include a driver for rotating the outlet about the vertical axis and/or a driver for rotating the outlet about the horizontal axis.

According to yet another form of the invention, a fire-fighting monitor includes a body having a fluid passageway, and with the body comprising an inlet pipe section forming an inlet and adaptable mount to a base on a fire truck, a 180 degree elbow intermediate pipe section rotatably mounted to the outlet of the inlet pipe section about a vertical axis, and a 180 degree elbow outlet pipe section rotatably mounted to the outlet of the intermediate pipe section about a horizontal axis and forming an outlet. The outlet pipe section has a larger radius of curvature than the intermediate pipe section wherein the outlet pipe section may rotate relative to the intermediate pipe section about the horizontal axis without interference from the intermediate pipe section.

In one aspect, the monitor further includes a driver for rotating the outlet pipe section about the horizontal axis. In addition, the outlet pipe section is sized to clear the driver when rotated about the horizontal axis.

In a further aspect, the monitor is configured as a boom monitor. In this configuration, the outlet is rotatable above horizontal up to about 90 degrees and below horizontal up to about 180 degrees.

In another aspect, the monitor is configured as a bumper monitor. In this configuration, the outlet is rotatable above horizontal up to about 180 degrees and below horizontal up to about 15 degrees.

Accordingly, the present invention provides a compact monitor while achieving greater flow efficiency and further a greater range of motion than heretofore known.

Theses and other objects, advantages, purposes, and features of the invention will become more apparent from the study of the following description taken in conjunction with the drawings.

DETAILED DESCRIPTION OF THE DRAWINGS

DETAILED DESCRIPTION OF THE PREFERRED EMBODIMENTS

Figure 1:
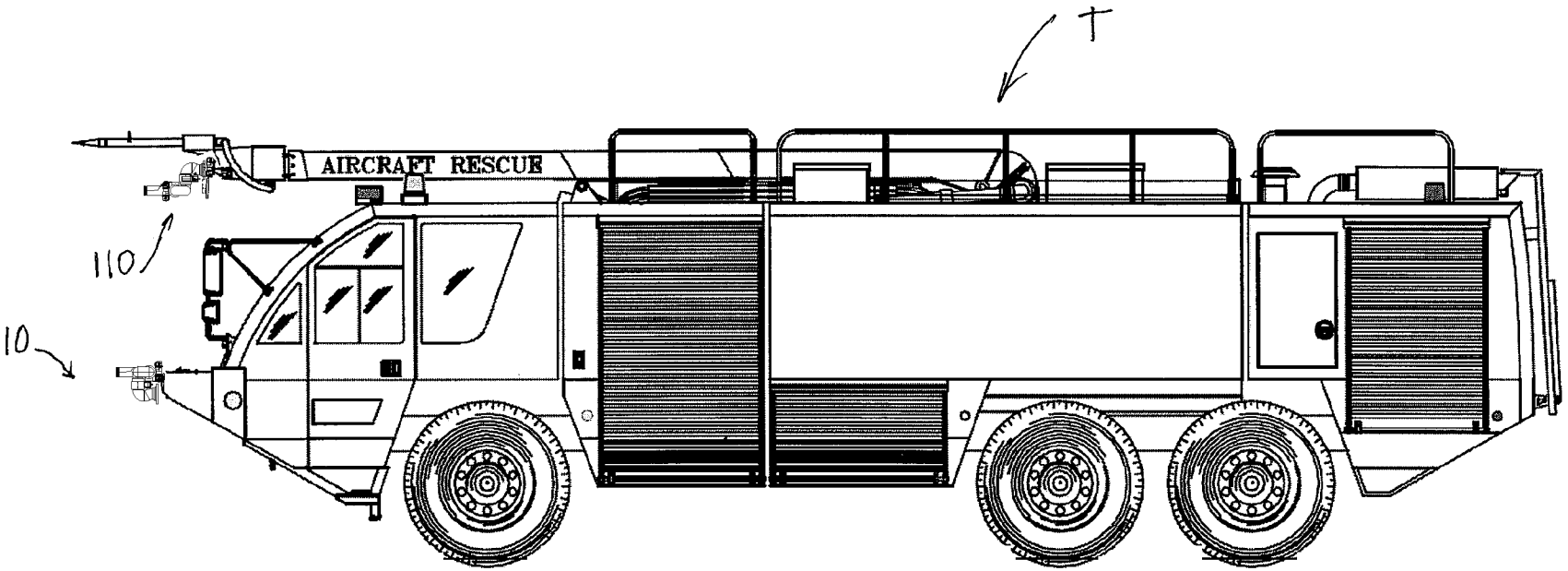
FIG. 1 is a side elevation of a fire truck incorporating the monitors of the present invention.

Referring to FIG. 1, the numeral 10 generally designates a monitor of the present invention that is particularly suitable for use on an ARFF (aircraft rescue fire fighting) truck T. Truck T may have two monitors, a monitor 10 that is mounted at the bumper of the truck for directing fluid, such as water, form or other chemicals, to the underside of an aircraft, and a second monitor 110 that is mounted to the end of an articulating boom, which is used to direct fluid to the aircraft from above. As will be more fully described below, each monitor has a desired range of motion in order to achieve its fire fighting function and, further, may be assembled from common components that are reconfigured depending on whether the monitor is to be used as a bumper monitor or a boom monitor.

Figure 2:
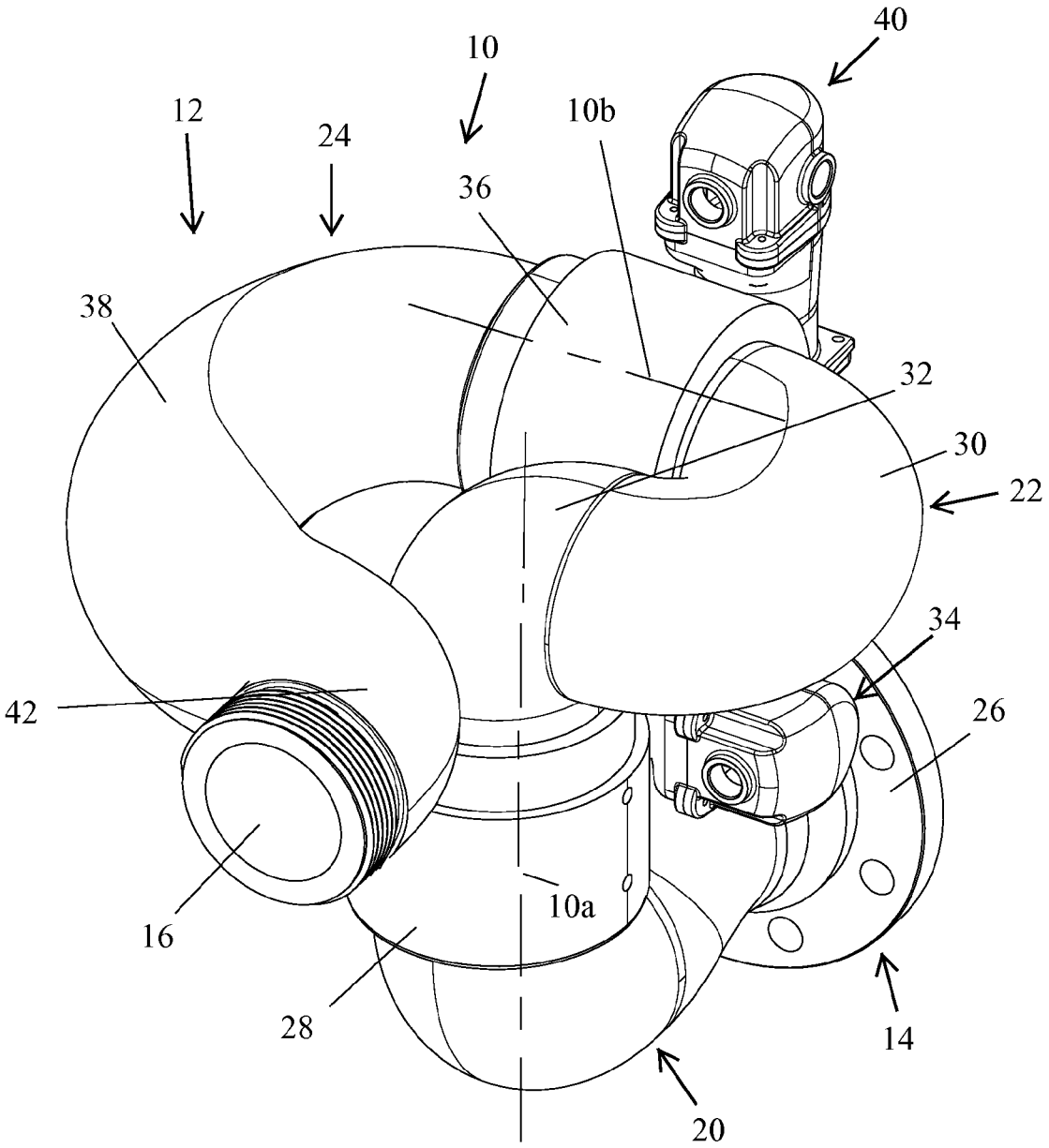
FIG. 2 is a top perspective view of a monitor of the present invention.

As best seen in FIG. 2, monitor 10 includes a housing 12 with an inlet 14, which is adapted to connect to a base on a fire truck that provides a supply of fire fighting fluid, such as water, foam, or the like, and an outlet 16. In the illustrated embodiment, monitor 10 is configured as a bumper monitor for ARFF truck T; therefore, in the illustrated embodiment inlet 14 is adapted to connect to a fixed base provided at the ARFF truck bumper. As will be more fully described below, housing 12 is configured so that outlet 16 can be rotated about a vertical axis 10*a* through a horizontal travel of 360 degrees and can be rotated about a horizontal axis 10*b* through a vertical range of travel in a range of about 195 degrees, starting at about a 15 degrees position below (−15 degrees) horizontal position to about a 180 degree position above horizontal position without interfering with the housing or the drive components, more fully described below.

Figure 3:
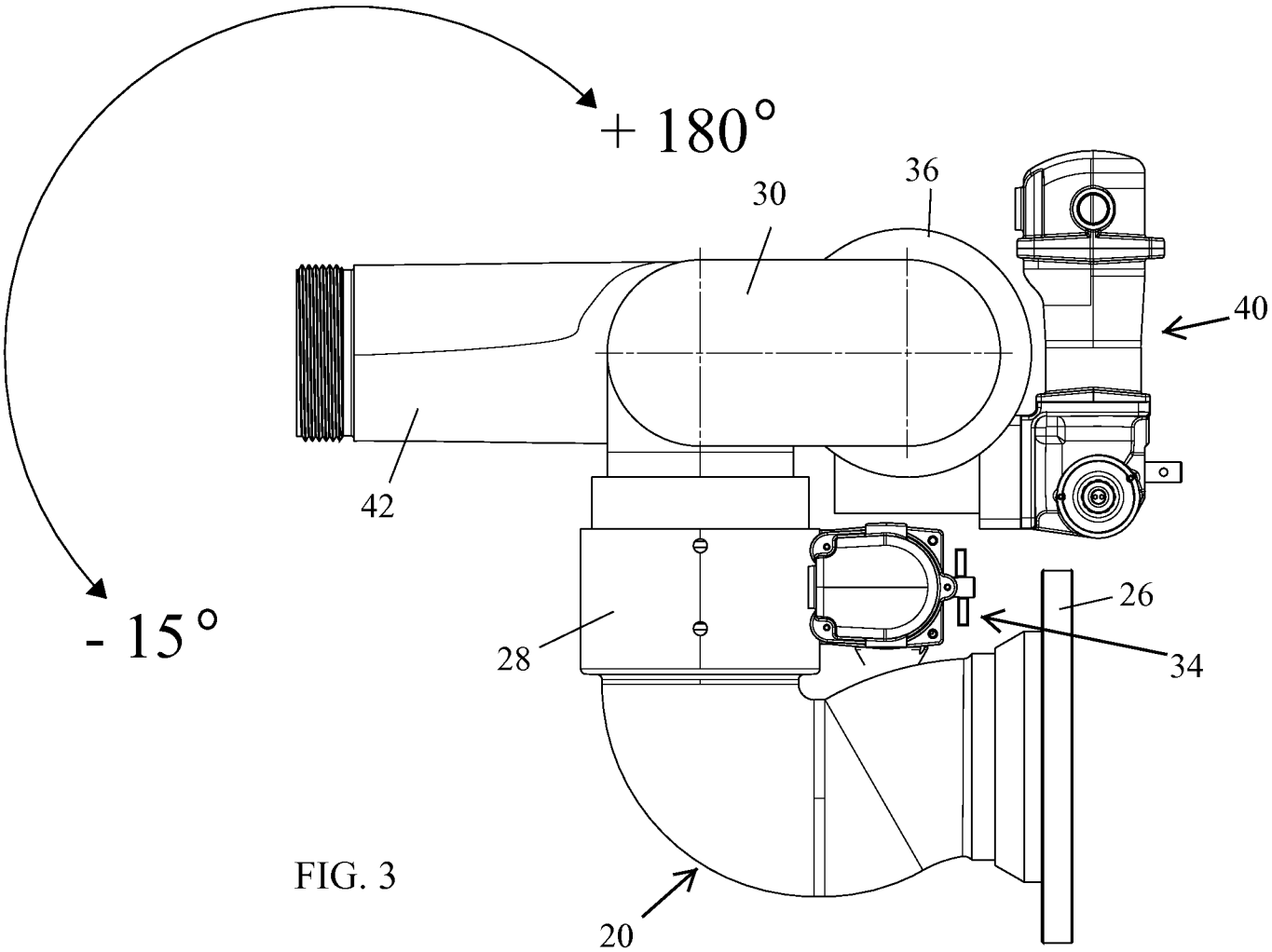
FIG. 3 is a side elevation view of the monitor of FIG. 2.
Figure 4:
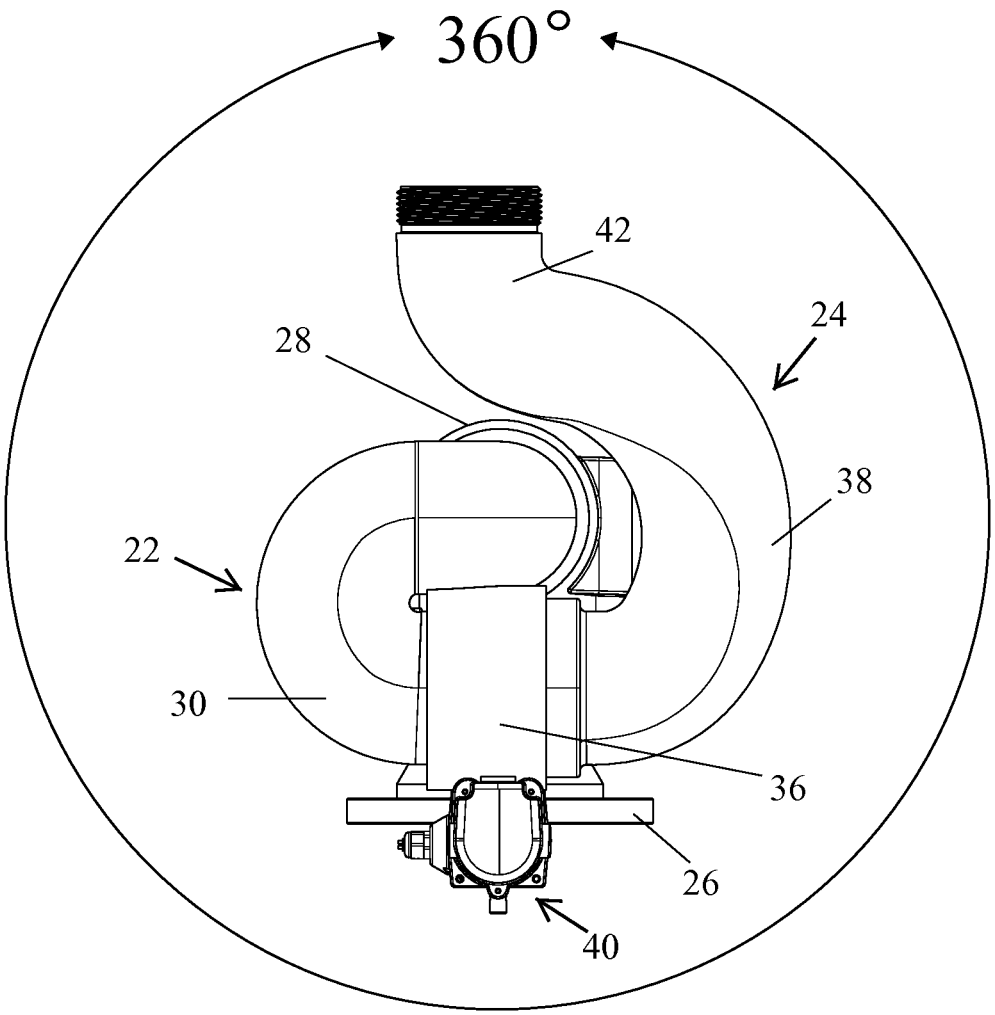
FIG. 4 is a top plan view of the monitor of FIG. 2.

As best seen in FIGS. 2-4, housing 12 is formed from a plurality of pipe sections, including an inlet pipe section 20, an intermediate pipe section 22, and an outlet pipe section 24. In the illustrated embodiment, inlet pipe section 20 includes a mounting flange 26 that mounts monitor 10 to the bumper at a fixed base or supply outlet provided at the bumper. As will be more fully explained below, similar to the aerial or boom mounted monitor 110, inlet pipe section 20 comprises a 90 degree elbow with an enlarge collar 28 at its distal end and flange 26 at its proximal end. When mounted to the bumper, inlet pipe section 20 will have a generally vertical orientation with flange 26 positioned below collar 28.

Intermediate pipe section 22 comprises a 180 degree pipe section 30 with a 90 degree elbow 32 that inserts into collar 28 to thereby rotatably mount intermediate pipe section 22 to inlet pipe section 20 about vertical axis 10*a*. Elbow 32 is rotatably supported and sealed in collar 28 by bearings and seals, such as o-ring seals, and is mounted for 360 degree rotation in collar about axis 10*a* and, further, may be driven by a driver 34. When mounted to inlet pipe section 20, intermediate pipe section 22 therefore generally lies in a horizontal plane.

The distal end of intermediate pipe section 22 includes an enlarged collar 36 for rotatably receiving the proximal end of outlet pipe section 24, which is also rotatably supported and sealed in collar 36, for example by bearings and o-ring seals, and is supported for rotatable movement in the collar about a horizontal axis 10*b* over at least about a 195 degree range, starting at about a 15 degree position below (or −15 degrees) horizontal to a 180 degree position above horizontal. Further the distal end of pipe section 24 is threaded for mounting a nozzle therein on.

Monitor 10 also includes a second driver 40 for driving outlet pipe section 24 about horizontal axis 10*b* to thereby selectively position outlet 16 of monitor 10. Suitable drivers for drivers 34 and 40 include wired or RF controlled drivers such as the drivers described in copending U.S. application Ser. No. 12/174,866, filed Jul. 17, 2008, entitled FIRE-FIGHTING DEVICE FEEDBACK CONTROL (ELK01 P-326A) and U.S. Pat. Nos. 7,243,864; 7,191,964; and 6,994,282, all commonly owned by Elkhart Brass Manufacturing Company, Inc., and which are incorporated by reference herein in their entireties.

In order to allow outlet 16 to pivot below horizontal, outlet pipe section 24 is configured as a 180 degree pipe section 38 with a 90 degree elbow 42 at its distal end, and with pipe section 38 sized so that it is larger than pipe section 22. For example, its inside length A (FIG. 6) is greater than the distance from the inside of the proximal end of outlet pipe to the outside surface of intermediate pipe (shown as dimension B in FIG. 6) or stated in another way the distance from the centerline of the input end of the 180 degree pipe section 38 to the centerline of the outlet end of pipe section 38 is greater than the centerline to centerline dimension of the 180 degree pipe section 30 of intermediate pipe section 22. Optionally, dimension A may be increased to clear collar 28 so that outlet 16 may have an even greater range of motion below horizontal.

Figure 5:
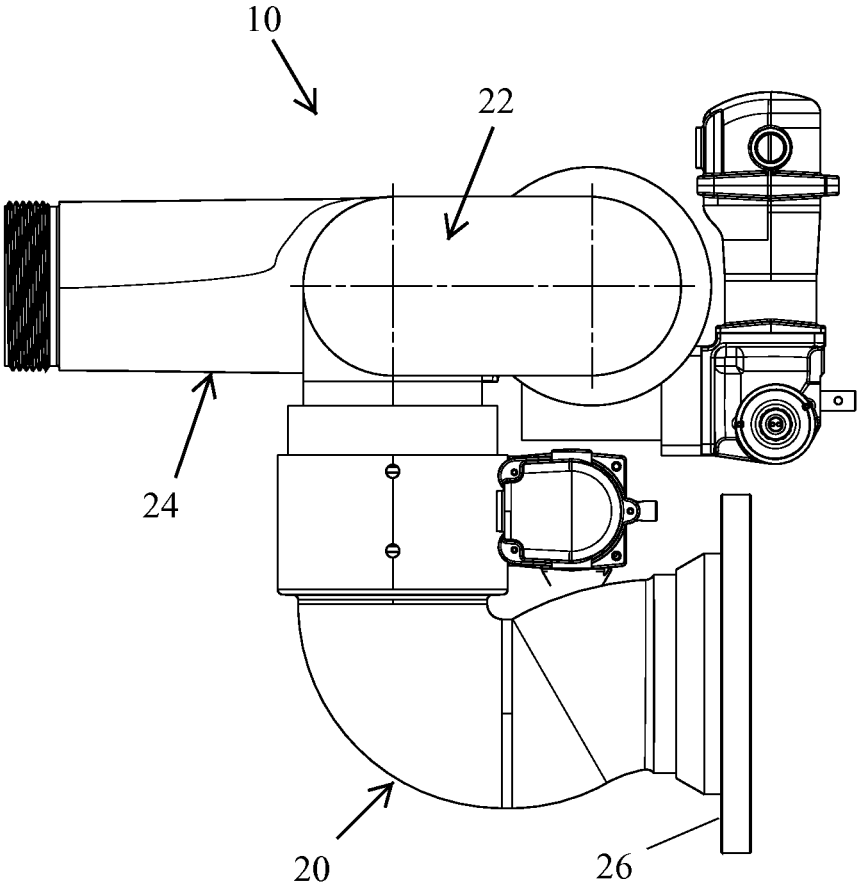
FIG. 5 is an enlarged side elevation view of the monitor of FIG. 2.
Figure 6:
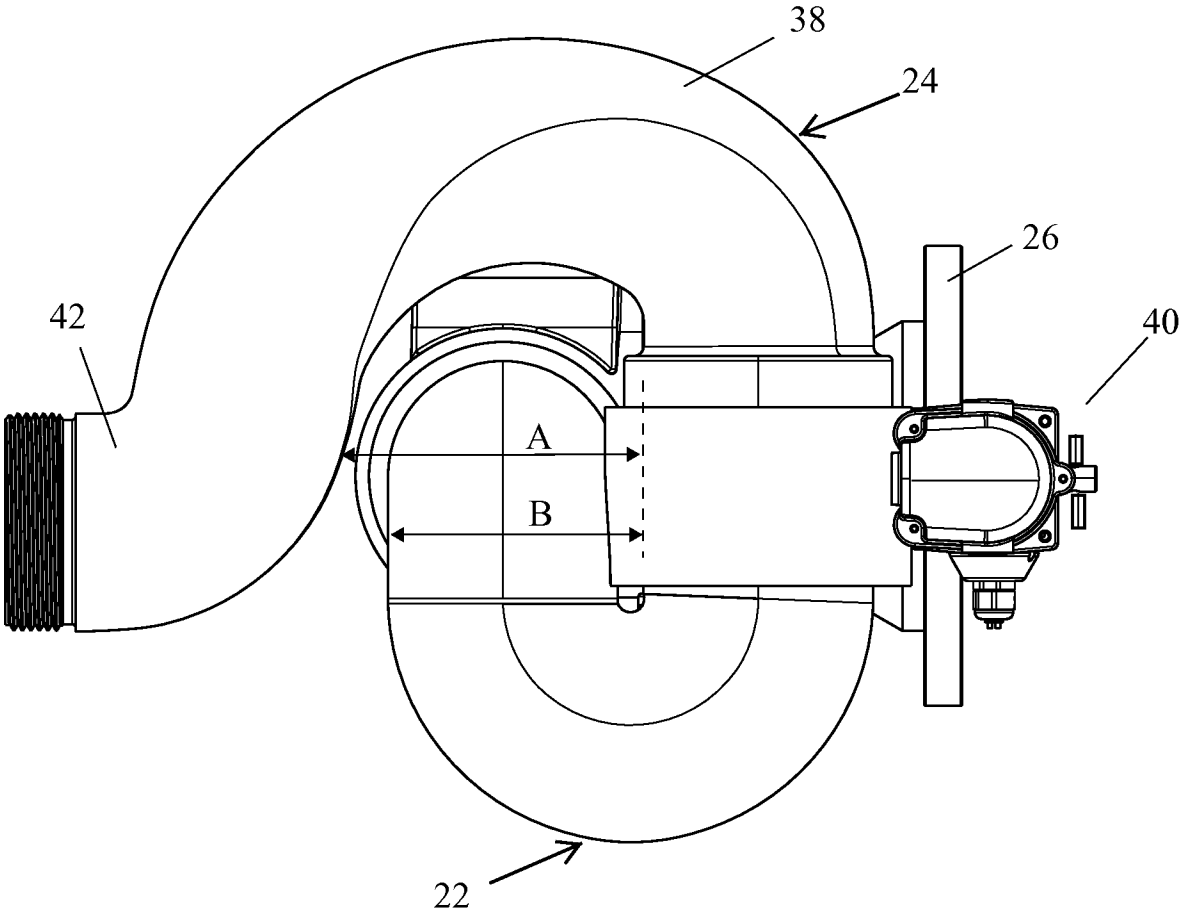
FIG. 6 is an enlarged top plan view of the of the monitor of FIG. 2.
Figure 7:
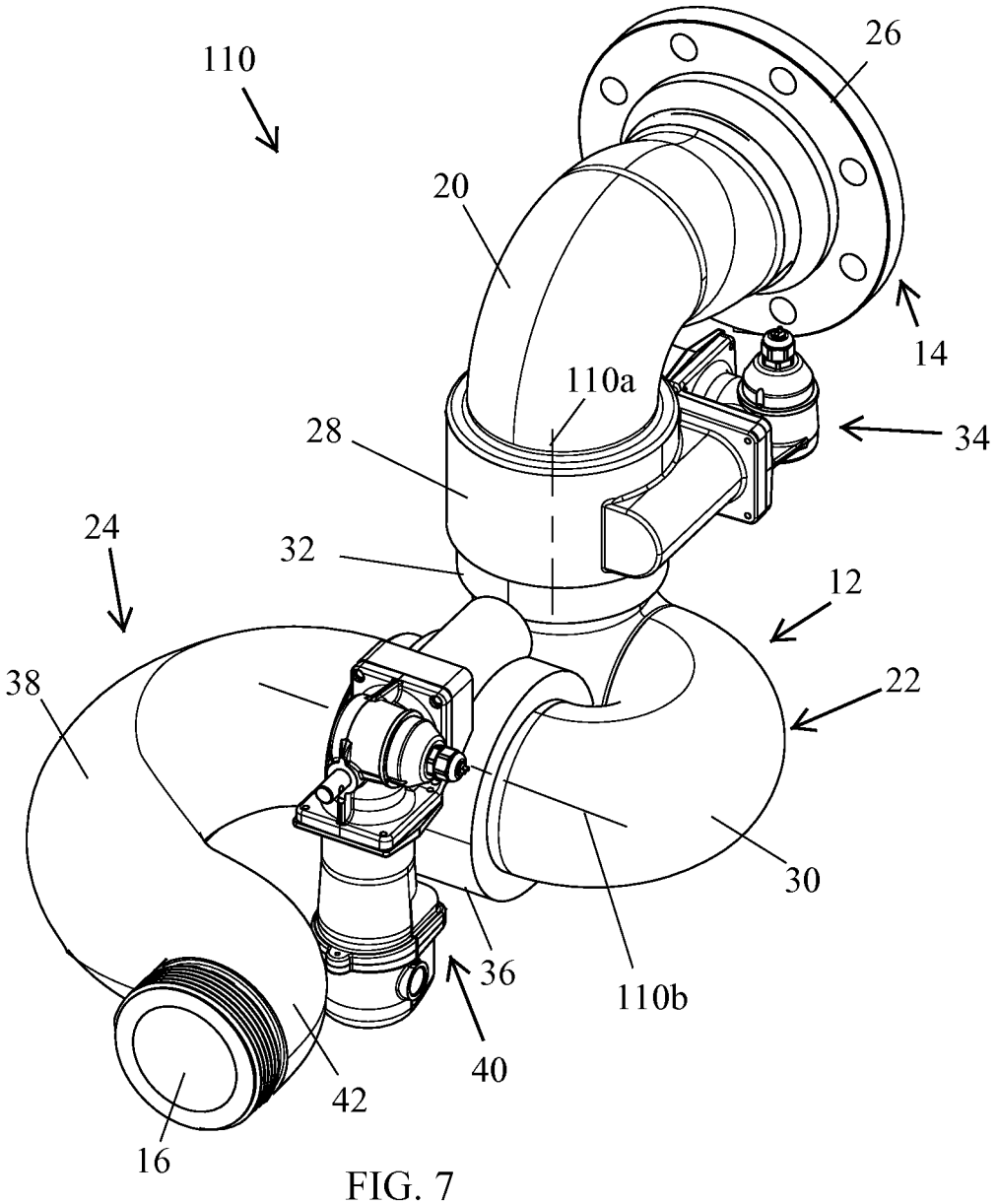
FIG. 7 is a top perspective view of another embodiment of monitor of the present invention.
Figure 8:
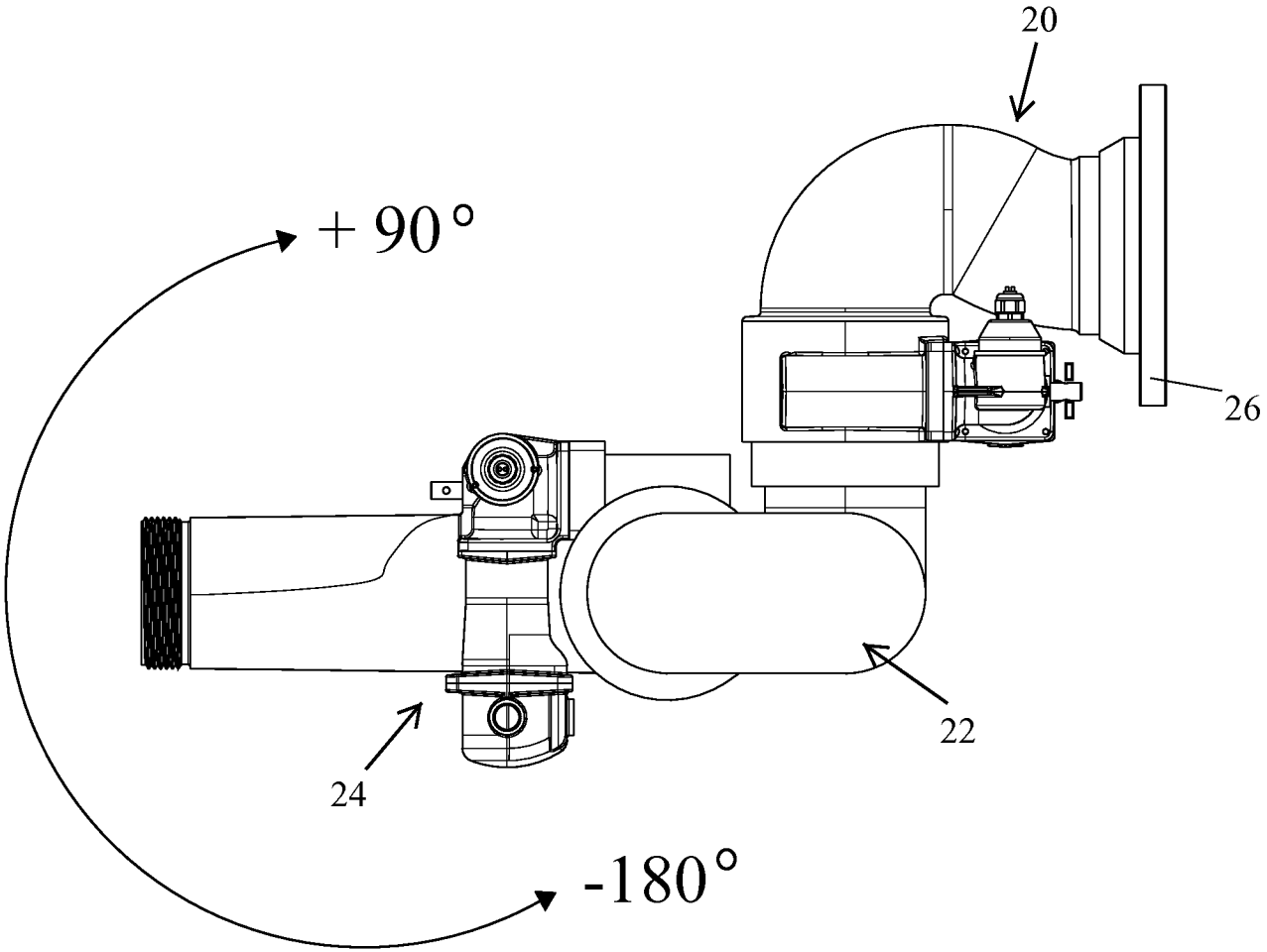
FIG. 8 is a side elevation view of the monitor of FIG. 7.
Figure 9:
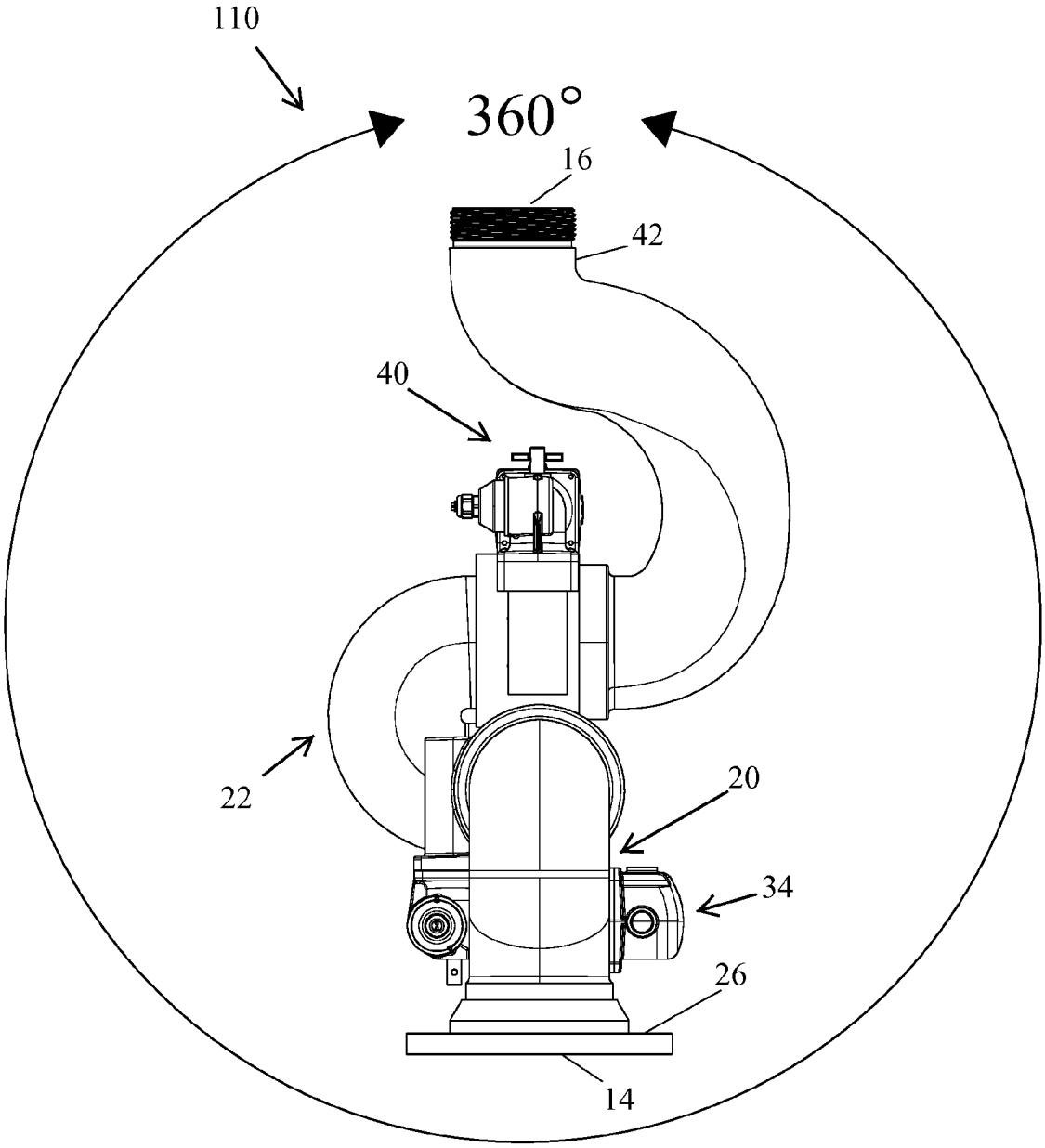
FIG. 9 is a top plan view of the monitor of FIG. 7.

For example, referring to FIG. 6, for a monitor assembled from 4 inch diameter pipe sections, the distance from the proximal end of pipe section 38 to its outer-most point at the 180 degree bend may be about 8.6 inches, while the similar dimension for intermediate pipe section 22 may be about 7.1 inches in one preferred form. Similarly, referring to FIG. 5, for a monitor with 4 inch diameter pipe sections, the distance from the mounting surface of flange 26 to the distal end of outlet pipe section 24, may be appropriately 17.7 inches. The centerline to centerline distance between the inlet and the intermediate pipe may be approximately 9.2 inches. And the overall height of the monitor may then be about 18.6 inches (as measured from the bottom of flange 26 to the top of driver 40 when the outlet pipe section is at a horizontal orientation). It should be understood that these dimensions are exemplary of a compact four inch diameter pipe section monitor. Further, with this configuration it has been found that there is a reduced friction loss as compared to current monitors and also an increase greater range of motion than heretofore known.

Referring to FIGS. 7-11, monitor 10 may be reconfigured as a boom monitor 110 wherein the outlet 16 is similarly rotatable 360 degrees about a vertical axis 110*a* and moved vertically about the horizontal axis in a range of about 180 degrees below (−180 degrees) horizontal to about 90 degrees above horizontal. In the boom monitor configuration, inlet pipe section 20 is oriented so that its inlet is above its outlet and further such that its outlet is reoriented 180 degrees about its horizontal axis from its orientation in monitor 10.

Intermediate pipe section 22 in monitor 110 has the same horizontal arrangement (or mirror image horizontal arrangement) as it does on monitor 10 but is beneath pipe section 20 and also is mounted for 360 degree rotation about vertical axis 110*a* of monitor 110. Outlet pipe section 24, on the other hand, may be pivotally mounted for a greater forward rotation than it is in monitor 10, for example, 180 degrees below horizontal (−180 degrees) and a smaller rearward rotation, for example to 90 degrees above the horizontal.

Figure 10:
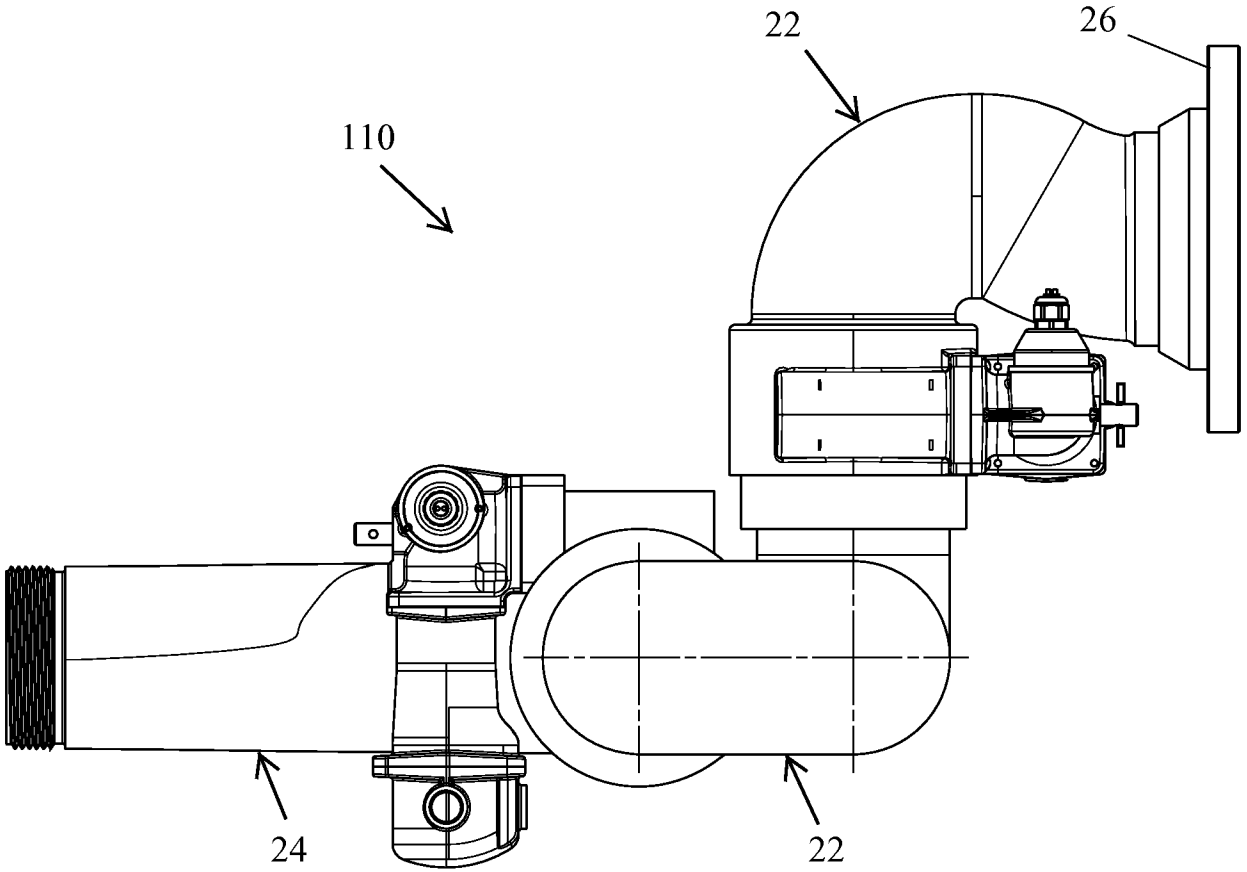
FIG. 10 is an enlarged side elevation view of the monitor of FIG. 7.
Figure 11:
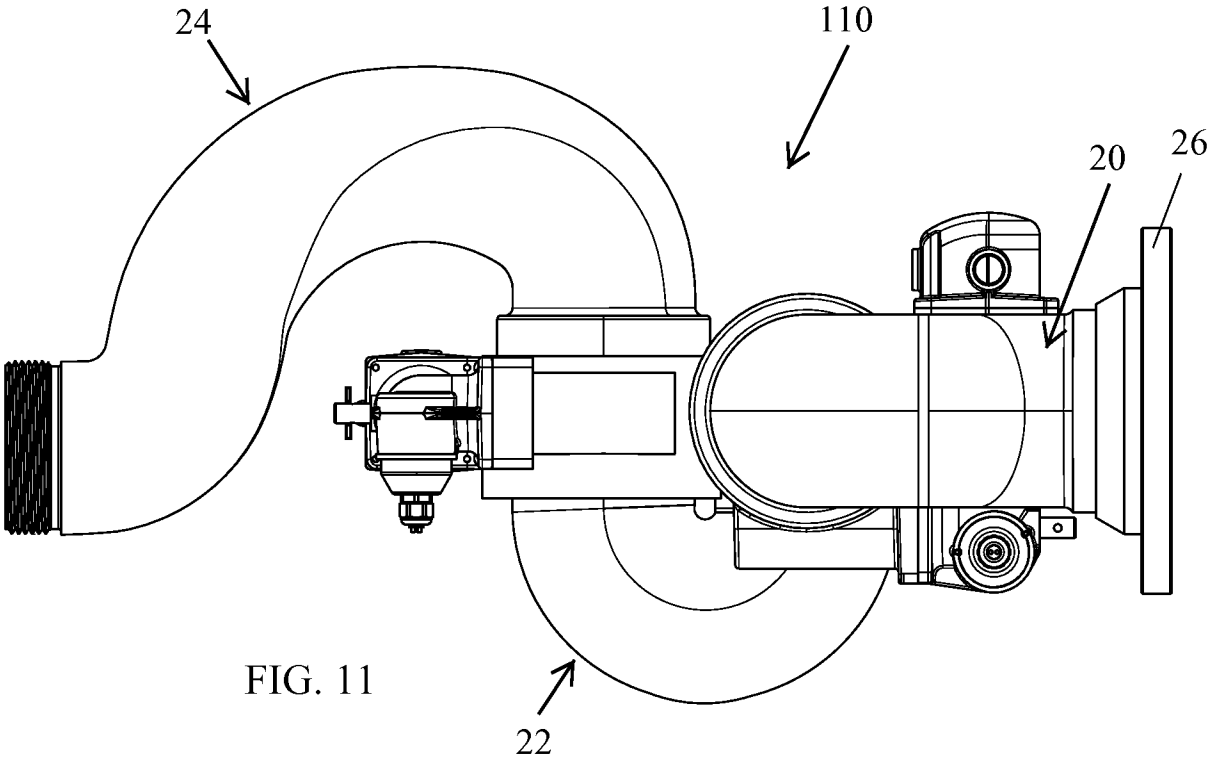
FIG. 11 is an enlarged top plan view of the monitor of FIG. 7.

Again, similar to monitor 10, monitor 110 has a compact arrangement. For example, referring to FIG. 10, for a monitor assembled from 4 inch diameter pipe sections, the overall height of the monitor (with the outlet in the horizontal orientation) may be about 18.6 inches with an overall maximum width of about 27.7 inches. Similarly, the overall length (as seen in FIG. 11) may be about 15.7 inches (similar to monitor 10). Further, the centerline from the inlet to the centerline of the intermediate pipe (and the outlet when the outlet is in the horizontal orientation) may be about 9.2 inches. The dimension from the mounting surface of flange 26 to the centerline of the outlet of intermediate pipe 22 may be about 14 inches. As best seen in FIG. 10, monitor 110 may be sized or dimensioned such that the distance from the centerline of inlet 14 is about 8.4 inches to the outermost point of outlet pipe (at its 180 degree bend). The dimension from the centerline of the inlet 14 to the outermost point of intermediate pipe (at its 180 degree bend) may be about 7.1 inches. Again, these dimensions are exemplary of one compact configuration of a 4 inch pipe boom monitor of the present invention.

In this manner, in either configuration of the monitor, i.e. boom or bumper arrangement, outlet 16 has a range of motion that allows the monitor to provide a greater range than prior art monitors whether it is from above or below the aircraft than heretofore known. In addition, with the present configuration, the size of the pipe sections may be increased or decreased to provide a greater range of motion while still optionally maintaining the overall dimensions of a conventional monitor.

It should be understood that although one example of a pipe size section is provided, the concept of this invention may be used with other size pipe sections.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

We claim:

1. A fire-fighting monitor comprising:

a body having a fluid passageway and forming an inlet and an outlet;

said inlet being adapted to mount to a base on a fire truck;

said body being configured so that said outlet is rotatable about a vertical axis over a 360 degree range of motion, and said body being configured so that in a first mounted orientation, said outlet is rotatable about a horizontal axis over one range of motion from about 180 degrees above horizontal to about 15 degrees below horizontal, and said body being configured so that, in a second mounted orientation, said outlet is rotatable about the horizontal axis over another range of motion from about 180 degrees below horizontal to about 90 degrees above horizontal, wherein:

said inlet comprising an inlet pipe section and being adapted to mount to the base on the fire truck, said body further comprising a first 180 degree elbow intermediate pipe section rotatably mounted to an outlet end of the inlet pipe section about the vertical axis, and a second 180 degree elbow outlet pipe section rotatably mounted to an outlet end of the intermediate pipe section about the horizontal axis, said second 180 degree elbow forming said outlet, and said outlet pipe section having a larger radius of curvature than said intermediate pipe section wherein said outlet pipe section may rotate relative to said intermediate pipe section about the horizontal axis without interference from said intermediate pipe section.

2. The monitor according to claim 1, further comprising a first driver for rotating said outlet about the vertical axis.

3. The monitor according to claim 2, further comprising a second driver for rotating said outlet about the horizontal axis.

4. The monitor according to claim 1, further comprising a driver for rotating said outlet pipe section about the horizontal axis.

5. The monitor according to claim 4, wherein said outlet pipe section is sized to clear said driver when rotated about the horizontal axis.

6. The monitor according to claim 1, wherein said monitor comprises a boom monitor.

7. The monitor according to claim 1, wherein said monitor comprises a bumper monitor.

* * * * *